United States Patent [19]

Groetzinger

[11] Patent Number: 4,998,484

[45] Date of Patent: Mar. 12, 1991

[54] VERSATILE WALL MOUNT FOLDING TABLE

[75] Inventor: Charles R. Groetzinger, Racine, Wis.

[73] Assignee: Niche Design, Inc., Racine, Wis.

[21] Appl. No.: 405,511

[22] Filed: Sep. 11, 1989

[51] Int. Cl.[5] ..... A47B 23/00

[52] U.S. Cl. ..... 108/42; 108/115; 108/134; 108/152

[58] Field of Search ..... 108/42, 115, 134, 135, 108/152

[56] References Cited

U.S. PATENT DOCUMENTS

| | | | |
|---|---|---|---|
| 3,026,158 | 3/1962 | Freeman | 108/134 X |
| 3,605,652 | 9/1971 | Mohr | 108/152 |
| 3,606,846 | 9/1971 | Andrews et al. | 108/152 X |
| 4,605,131 | 8/1986 | Debus et al. | 108/152 X |
| 4,791,873 | 12/1988 | Towfigh | 108/134 X |
| 4,848,244 | 7/1989 | Bennett | 108/134 X |

FOREIGN PATENT DOCUMENTS

| | | | |
|---|---|---|---|
| 632762 | 2/1931 | Fed. Rep. of Germany | 108/134 |
| 1183481 | 1/1959 | France | 108/134 |

*Primary Examiner*—Peter A. Aschenbrenner
*Attorney, Agent, or Firm*—Foley & Lardner

[57] ABSTRACT

An improved and highly versatile wall mounted folding table with mounting brackets of various configurations, to allow the table to be mounted directly to planar wall surfaces and exposed wall support studs. By varying the vertical distance between the upper and lower mounting brackets, a forward sloping table surface is formed for use in drafting.

20 Claims, 5 Drawing Sheets

VERSATILE WALL MOUNT FOLDING TABLE

This invention relates to folding tables, and, more specifically to folding tables that are mounted to vertical support members, such as walls, wall studs and other building means that offer structural support.

Over the years, many different configurations of folding tables have evolved, to bridge the gap between the need for comfortable working height surfaces and the need for open space for day to day living. Often, it is desirable to have a working surface mounted to a wall, in a specific location for utility and generally out of the traffic pattern of that particular room. With changing daily needs for any given room, it is often difficult to predict a location for a wall mounted table that will not hamper future activities. Thus, folding wall mounted tables have evolved, to alleviate the problem of taking up valuable space in confined areas.

Typically, inventions are born from a particular need in a particular situation. Prior art shows that folding wall mounted tables have generally been needed in rooms that have walls of vertically planar surfaces, such as wall board, concrete, etc.. The methods of mounting these tables somewhat confines them to rooms of this type, thus requiring adaptation to rooms that are unfinished, with the building studs exposed. The methods of supporting these tables varies, according to the particular use to which the table will be subjected, with heavy duty type tables having massive structures of tubular steel and lighter duty tables having folding supports of flat interconnected pieces of steel. The locking mechanisms also vary, with some locking by means of a small tab formed in the steel of a first support rod that rests against a second support rod and some that simply rest against the table top. With the use of flat pieces of steel as support rods, lies the problem of total collapse when subjected to overload. Some of the aforementioned locking mechanisms are also prone to failure when too great a force is encountered.

While generally it is desirable for a table to be mounted in a horizontal position, it would at times be an advantage to mount a table in a tilting position when working on drawings and the like. The mounting brackets of prior art, do not take into account, special needs of this nature and have limited themselves to tables that mount on a horizontal plane only. These mounting brackets also require permanent mounting to the wall with the use of screws, bolts or other permanent fastening means.

Accordingly, the important object of this invention is to provide a folding wall mounted table system, that is adaptable to various wall configurations, with some being planar surfaces and others having exposed wall support members.

It is another important object of the invention to provide support members for the table in a channel configuration that will provide greater strength when subjected to heavy loads.

A further object of the inventions is to provide mounting brackets that can be placed at different distances from one another to adjust the tilt of the table top.

It is also an object of this invention to provide a mounting bracket that is adaptable to a stud mounted bracketing system of an earlier patent application titled "Stud Mounted Shelving & Storage System" that allows for the easy removal and movement of the table for changing needs.

Further objects and advantages of the invention will become apparent from a consideration of the drawings and ensuing description of it.

DRAWING DESCRIPTIONS

DETAILED DESCRIPTION

Figure 1:
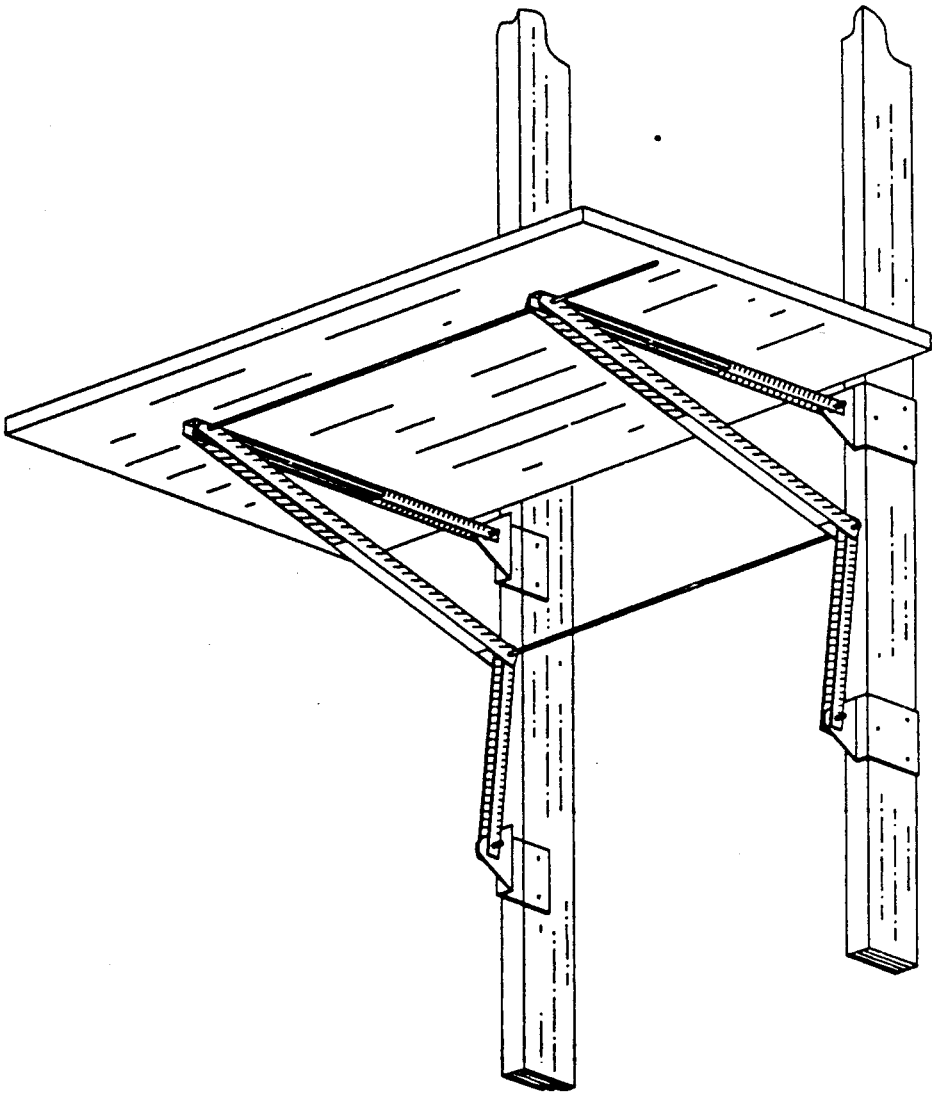
FIG. 1 shows a lower right perspective view of the folding work bench mounted to wall studs, in a raised position.
Figure 2:
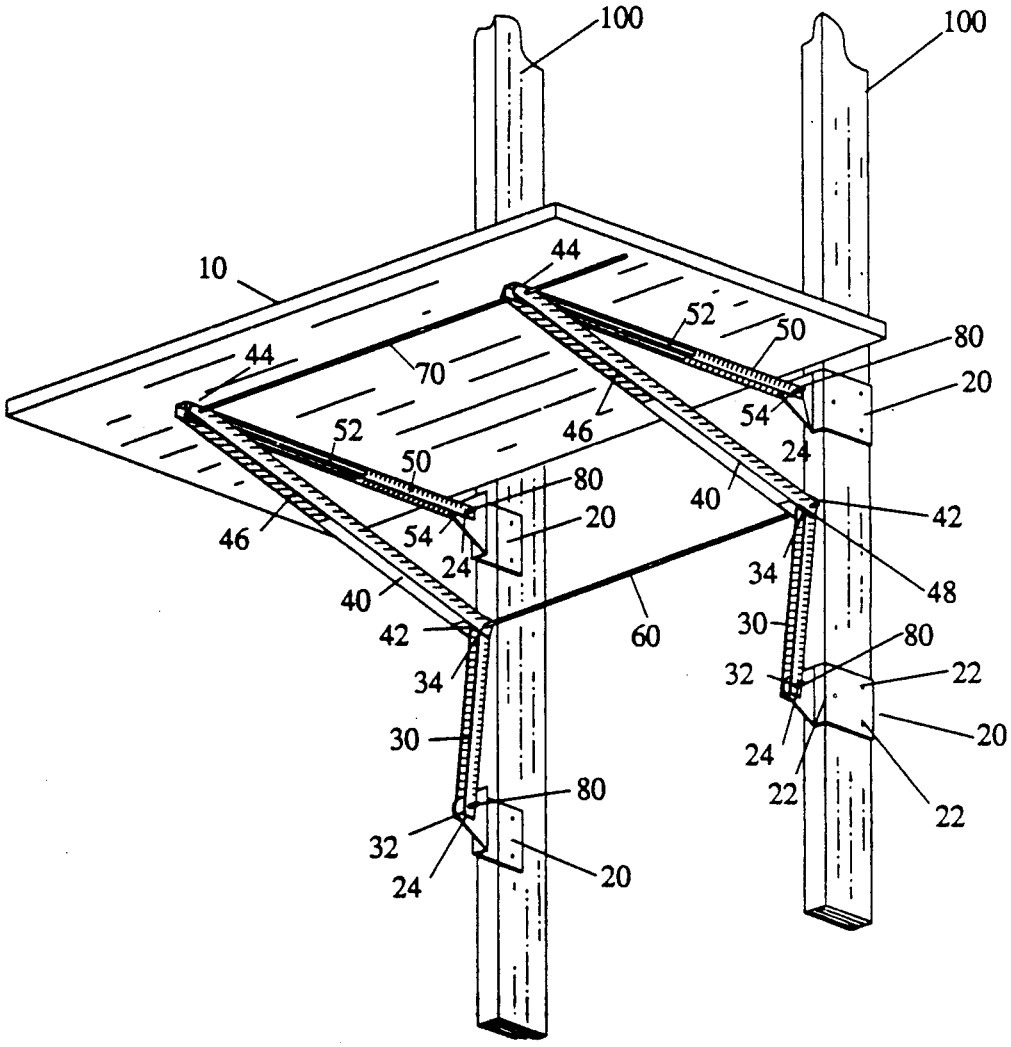
FIG. 2 shows a lower right perspective view of the folding work bench mounted to wall studs, in a raised position with details of the bench numbered for explanation.

Referring first to FIG. 1 and FIG. 2, there is shown, from a lower right perspective view, a vertical support mounted folding work bench. Shown in an elevated position, the bench top 10, a planar working surface, is mounted to two pivoting slide channels 50. A triangulated support is achieved through the use of upper support channels 40 and lower support channels 30 being pivotally mounted to one another at their intersection points. When in a raised position, the intersection point between the upper support channel 40 and lower support channel 30, rests against the vertical support member 100 thereby stabilizing the bench in a horizontal position.

Figure 3:
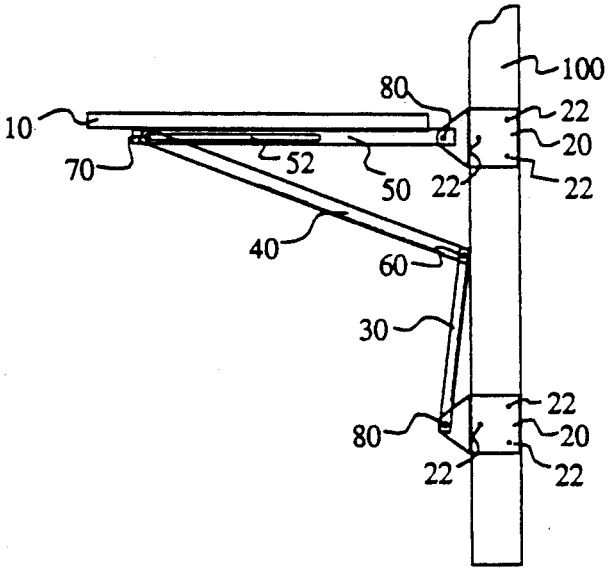
FIG. 3 shows a side view of the bench mounted to a wall stud in a raised position.
Figure 5:
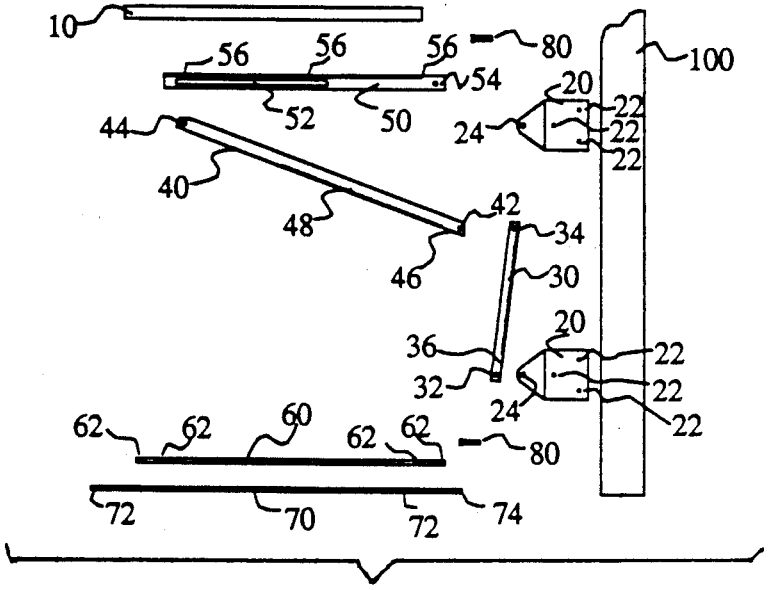
FIG. 5 shows a side view of the individual parts in an exploded state.

The pivoting mounting brackets 20, FIG. 3 and further detailed in FIG. 5, are attached to framing support members (wall studs) 100 by screwing or nailing said mounting brackets 20 to said wall studs 100 through the mounting holes 22. Four mounting brackets 20 are used, with two mounting brackets 20 being mounted to each of two wall studs 100 at a pre-determined distance on a vertical plane. The pivoting slide channels 50, are attached to the mounting brackets 20 by inserting clevis pins 80 through one hole 54 of the slide channel 50, then through the pivot point 24 in the mounting bracket 20 and finally through an opposing hole 54 on the slide channel 50. Said clevis pin 80 is then secured with a cotter pin or other known means of securing said clevis pin 80. The upper support channel 40 is attached to the pivoting slide channel 50 by putting an extended rod 70 through the pivot holes 44 of the upper support channel 40 and then through the slide slot 52 of the slide channel 50. At the intersection of the upper support channel 40 and the lower support channel 30, a connection is made with the use of another extended, but shorter rod 60, being placed into the pivot holes 42 and 34 of the upper and lower support channels 40 & 30. The rod 60 is then secured with cotter pins or other means through the holes 62 drilled in said rod 60. The lower support channel 30 is then mounted to the bottom mounting bracket 20 with a clevis pin 80 being placed through the pivot hole 32 on the lower support channel and the pivot hole 24 on the mounting bracket 20.

Figure 4:
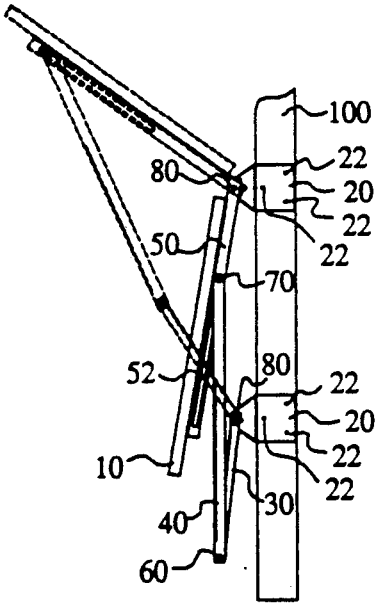
FIG. 4 shows a side view of the bench mounted to a wall stud in a lowered position.

Referring now to FIG. 4, a folded state is achieved by first raising the elevation of the bench top 10 and allowing the extended rod 70 to slide down the slot 52 in the slide channel 50 toward the rear. At the same time, the upper support channel 40 and lower support channel 30 pivot on the rod 60 to an elongated state along the same plane. By grasping the elongated slide rod 70, to hold it in place, the bench top 10 is then lowered, with gravity then breaking the plane between the upper support channel 40 and the lower support channel 30, allowing the channels 40 & 30, to pivot downward. To achieve a lowered state, it is necessary to have a relief slot 48, FIG. 5, cut in the front face of the upper support channel 40, to allow the slide channel 50 to fold into the upper support channel 40. Raising the bench to an elevated state is achieved by lifting the table top 10 to a rearward inclined position and applying a rearward pressure on the lower pivot rod 60, pushing the lower support channel 30 into the vertical support member 100 and then lowering the bench top 10 to a horizontal plane until the upper slide rod 70 comes in contact with the forward end of the slot 52 of the slide channel 50.

Figure 6:
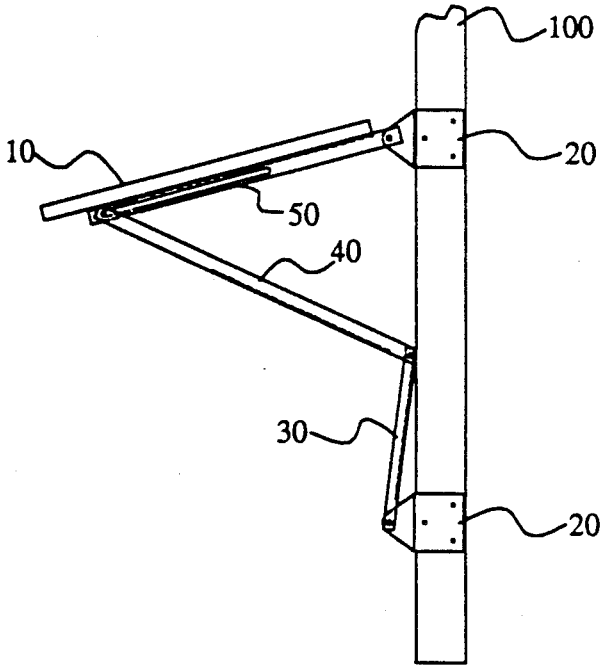
FIG. 6 shows a side view of the table, with mounting brackets mounted at a greater distance from each other on a vertical plane, which then puts the bench top into an inclined position, such as one would see on an ordinary drawing table.

Increasing the distance between the top and bottom mounting brackets 20 on a vertical plane, FIG. 6, raises the back side of the bench top 10, forming an inclined planar surface such as those tables that are normally used for drawing and drafting.

Figure 7:
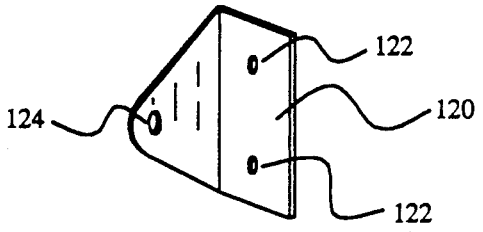
FIG. 7 shows an alternate style mounting bracket, for mounting the work bench to a finished or concrete wall.
Figure 8:
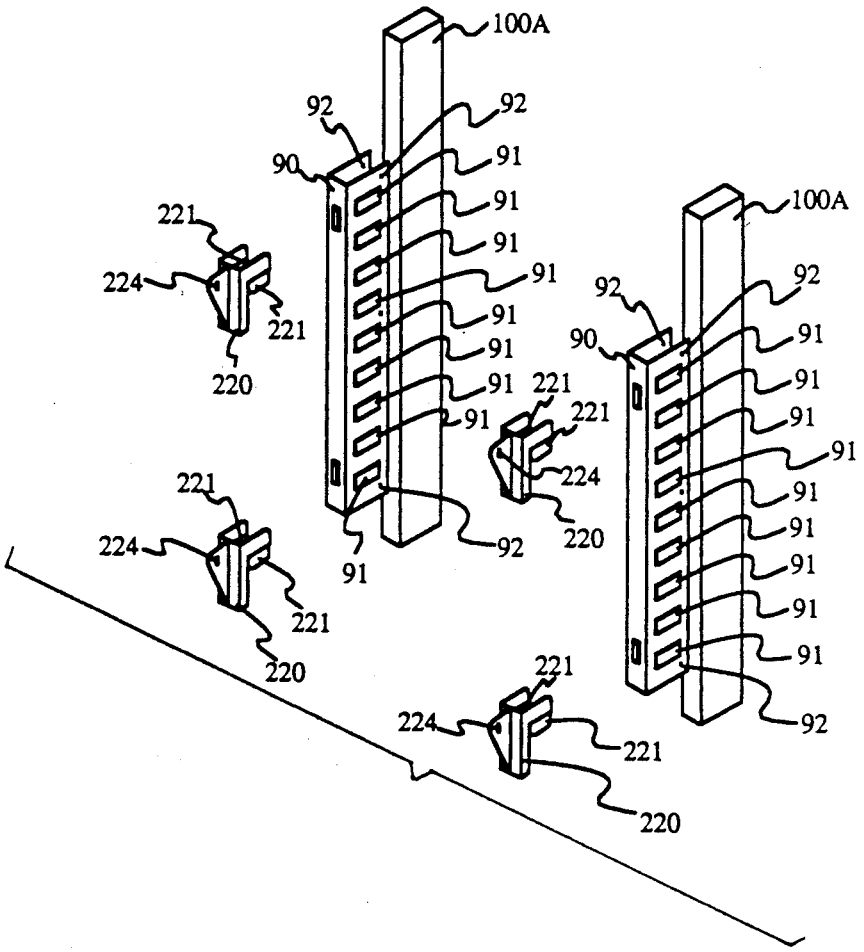
FIG. 8 shows an exploded view of an alternate style mounting bracket for mounting the work bench to adjustable wall stud brackets. Wall studs are shown in the background.

Several styles of pivoting mounting brackets 20 are employed, FIG. 2, FIG. 7 and FIG. 8, to meet different vertical support configurations. The mounting bracket 20 depicted in FIG. 2 is for use on a building wall stud. The mounting bracket is bent first at a 90 degree angle and then back back at 0 degrees to form support on the wall stud 100 thereby reducing shear forces on the fasteners used to attach said mounting bracket 20 to the wall stud 100. In FIG. 7 the mounting bracket 120, is bent at a right angle with larger mounting holes 122 to accept lag bolts, molly screws or cement anchor screws that will allow the mounting bracket 120 to be mounted to the vertical planar surface of a wall. FIG. 8 shows an easily adjustable mounting bracket 220, consisting of two pieces formed in opposite configurations welded or fastened together, with downward formed flanges 221 that fit into embossments 91, open at the top and bottom, formed into a bracket 90 that is fitted surrounding a building wall stud and attached to said wall stud 100 through fastener holes 92 with the use of screws or nails. This wall stud bracket 90 is the object of a patent pending titled "Stud Mounted Shelving and Storage System", Ser. No. 07/298,480

What is claimed is:

1. A folding wall-mounted table configured to lie in a generally vertical position when in a lowered state and having means for selectively positioning said table in either a horizontal or forward sloping state when said table is rotated upward to a locked position, by positioning respective wall mounting brackets to various vertical distances, said table comprising;

four wall mountable support brackets formed at a ninety degree angle with respect to, and adapted to be secured with fasteners to, a generally vertical wall, with two of said wall brackets being mounted vertical to one another at a pre-determined distance and the second set of said wall brackets being mounted at a pre-determined distance to one another, and spaced apart from said first set of wall brackets and;

a rigid, generally planar table surface with;

two slotted channels fastened to said table, adapted to pivotally connect to two upper said wall support brackets for rear support thereof, and;

a first and second set of support arms comprised of an upper support channel and a lower support channel, pivotally connected to one another, with said upper support channel having the means to slide and pivotally connect to said slotted channel mounted to said table and the lower support channel having the means to pivotally attach to the lower set of said wall support brackets said lower support channel being received against said vertical wall when said table is rotated upward and said upper support channel pivotally slides down said slotted channel in a forward direction and said upper support channel and said lower support channel are rotated inward.

2. The folding table of claim 1 further comprising a pivot shaft interconnecting the said upper support channel and the said lower support channel is comprised of an elongated rod to permit the rotation of the said upper support channel and the lower support channel of both said support arms into a locked position against the said vertical wall simultaneously.

3. The folding table of claim 2 wherein the said sliding pivot point interconnecting the said upper support channels and the said slotted channel is connected with a rod that extends through both said support arms and both said slotted channels to a position just under the outside edge of said table top as a means to keep said sliding pivot rod from sliding uncontrollably down said slotted channel and as a means to hold said support arms in place while the said table is being rotated downward to a stored position.

4. A folding wall mounted table whereby said table is mountable to building support studs with mounting brackets that have a means for fastening said mounting brackets to the said building support stud and said mounting brackets are bent at a ninety degree angle and then bent back to a zero degree angle as a means to alleviate shear stress upon the fastener used to attach said mounting bracket to said building support stud and whereby said table is configured to lie in a generally vertical position when in a lowered state and having means for selectively positioning said table in either a horizontal or forward sloping state when said table is rotated upward to a locked position, by positioning the wall mounting brackets to various vertical distances, said table comprising;

four building support stud mountable support brackets adapted to be secured to a generally vertical building support stud with two of said support brackets being mounted vertical to one another at a pre-determined distance and the second set of said support brackets being mounted at a pre-determined distance to one another, and spaced apart from said first set of support brackets and;

a rigid, generally planar table surface with;

two slotted channels fastened to said table, adapted to pivotally connect to two upper said support brackets for rear support thereof, and;

a first and second set of support arms comprised of an upper support channel and a lower support channel, pivotally connected to one another, with said upper support channel having the means to slide and pivotally connect to said slotted channel mounted to said table and the lower support channel having the means to pivotally attach to the lower set of said support brackets said lower support channel being received against said vertical building support stud when said table is rotated upward and said upper support channel pivotally slides down said slotted channel in a forward direction and said upper support channel and said lower support channel are rotated inward.

5. The folding table of claim 4 further comprising a pivot shaft interconnecting the said upper support channel and the said lower support channel is comprised of an elongated rod to permit the rotation of the said upper support channel and the lower support channel of both said support arms into a locked position against the said vertical wall simultaneously.

6. The folding table of claim 5 wherein the said sliding pivot point interconnecting the said upper support channels and the said slotted channel is connected with a rod that extends through both said support arms and both said slotted channels to a position just under the outside edge of said table top as a means to keep said sliding pivot rod from sliding uncontrollably down said slotted channel and as a means to hold said support arms in place while the said table is being rotated downward to a stored position.

7. A folding wall mounted table whereby said table is mountable to building support studs by first attaching to said building support studs an elongated channel that surrounds the said building support stud and whereby said elongated channel has evenly spaced means of connection in the form of outwardly formed embossments placed on opposing sides of said wall stud brackets wherein the top and bottom of said embossments are open to allow a flange formed in the table support bracket to slide into said embossment as a means of adjustability and whereby said table is configured to lie in a generally vertical position when in a lowered state and having means for selectively positioning said table in either a horizontal or forward sloping state when said table is rotated upward to a locked position, by positioning the wall mounting brackets to various vertical distances within the evenly spaced said embossments of the said wall stud bracket, said table comprising;

at least two said wall stud brackets fastened to two said building support studs at a suitable height and;

four said wall stud bracket mountable table support brackets being mounted to said wall stud bracket by placing the flange of said table support bracket within the said embossment of said wall stud bracket and with the said table support brackets being mounted vertical to one another at a predetermined distance and the second set of said support brackets being mounted at a pre-determined distance to one another, and spaced apart from said first set of support brackets along a horizontal plane and;

a rigid, generally planar table surface with;

two slotted channels fastened to said table, adapted to pivotally connect to two upper said support brackets for rear support thereof, and;

a first and second set of support arms comprised of an upper support channel and a lower support channel, pivotally connected to one another, with said upper support channel having the means to slide and pivotally connect to said slotted channel mounted to said table and the lower support channel having the means to pivotally attach to the lower set of said support brackets said lower support channel being received against said vertical building support stud when said table is rotated upward and said upper support channel pivotally slides down said slotted channel in a forward direction and said upper support channel and said lower support channel are rotated inward.

8. The folding table of claim 7 further comprising a pivot shaft interconnecting the said upper support channel and the said lower support channel is comprised of an elongated rod to permit the rotation of the said upper support channel and the lower support channel of both said support arms into a locked position against the said vertical wall simultaneously.

9. The folding table of claim 8 wherein the said sliding pivot point interconnecting the said upper support channels and the said slotted channel is connected with a rod that extends through both said support arms and both said slotted channels to a position just under the outside edge of said table top as a means to keep said sliding pivot rod from sliding uncontrollably down said slotted channel and as a means to hold said support arms in place while the said table is being rotated downward to a stored position.

10. An apparatus for selectively positioning a table between a folded and an unfolded position, the apparatus comprising:

upper and lower bracket means for mounting said apparatus to a generally vertical surface;

a first slide channel pivotally connected to said upper bracket means and configured to be connected to a table;

an upper support channel having a first and a second end; and a lower support channel having a first and a second end; wherein said first end of said upper support channel is disposed for sliding engagement with said slide channel as the table is positioned between said unfolded and said folded positions;

said second end of said upper support channel is pivotally connected to said first end of said lower support channel; and said second end of said lower support channel is pivotally connected to said lower bracket means.

11. The apparatus of claim 10 wherein said first slide channel is configured to assume a generally horizontal position when the table is in said unfolded position, said first slide channel being further configured to define an acute angle with respect to the generally vertical surface when the table is in said folded position.

12. The apparatus of claim 11 further comprising:

a planar table member affixed to said first slide channel;

and a slide slot extending lengthwise along said slide channel.

13. The apparatus of claim 12 wherein said slot comprises a first end generally proximate upper bracket means and a second end remote from said upper bracket means and said first end of said slot, wherein said first end of said upper support channel engages said second end of said slot when the table is in said unfolded position, and further wherein said first end of said upper support channel is disposed proximate said first end of said slot when the table is in said folded position.

14. The apparatus of claim 13, further comprising a first pivotal connection disposed intermediate said upper support channel and said lower support channel and configured to facilitate pivotal motion therebetween.

15. The apparatus of claim 14, wherein said first pivotal connection is configured to bearingly engage the generally vertical surface to thereby support the table in said unfolded position.

16. The apparatus of claim 13, further comprising a second pivotal connection, including an elongated slide rod extending through said first end of said upper support channel and through said slide slot disposed in said slide channel, said second pivotal connection being configured to facilitate pivoting and sliding motion between said slide channel and said upper support channel.

17. The apparatus of claim 16, further comprising a second slide channel disposed parallel to said first slide channel and pivotally connected to said upper bracket means.

18. The apparatus of claim 17, further comprising:

a second upper support channel having a first and a second end; and a second lower support channel having a first and a second end;

wherein said first end of said second upper support channel is disposed to cooperate with said second slide channel and said second end of said second upper support channel is pivotally connected to said first end of said second lower support channel, said second end of said second lower support channel being pivotally connected to said lower bracket means.

19. The apparatus of claim 18, wherein upper bracket means comprises first and second brackets.

20. The apparatus of claim 18, wherein lower bracket means comprises first and second brackets.

* * * * *